United States Patent [19]

Acker

[11] 4,326,546

[45] Apr. 27, 1982

[54] COMBINATION LIPSTICK DISPLAY AND STORAGE CONTAINER

[76] Inventor: Stanley Acker, c/o 14 Cairngorm Rd., New City, N.Y. 10956

[21] Appl. No.: 211,193

[22] Filed: Nov. 28, 1980

[51] Int. Cl.[3] ..... A45D 40/00; B65D 85/72

[52] U.S. Cl. ..... 132/79 C; 206/385; 206/461; 206/581

[58] Field of Search ..... 132/79 A, 79 B, 79 C; 206/385, 461, 462, 471, 581, 806

[56] References Cited

U.S. PATENT DOCUMENTS

| | | | |
|---|---|---|---|
| 2,074,378 | 3/1937 | Elkins | 206/581 |
| 2,094,006 | 9/1937 | Farrell | 206/581 |
| 2,294,257 | 8/1942 | Vovarhelt et al. | 206/581 |
| 2,497,950 | 2/1950 | Lohr et al. | 206/385 |
| 2,512,476 | 6/1950 | Birnkrant et al. | 206/385 |
| 3,123,661 | 3/1964 | Roman | 206/385 |
| 3,249,217 | 5/1966 | Irving | 206/461 |
| 3,869,043 | 3/1975 | Warner et al. | 206/385 |
| 4,266,671 | 5/1981 | Roccaforte | 206/806 |

*Primary Examiner*—Robert A. Hafer
*Attorney, Agent, or Firm*—Bauer & Amer

[57] ABSTRACT

A container or holder for a lipstick tube in which the lipstick is mounted in front of a mirror of an appropriate rectangular shape such that the mirror reflects the image of the lipstick to a potential customer and thus enhances the point-of-sale presentation thereof, and after purchase the mirror can be held in a generally horizontal orientation and has adequate length for the user to see enough of a reflected image of her lips to assist in the application of the lipstick mass.

3 Claims, 6 Drawing Figures

COMBINATION LIPSTICK DISPLAY AND STORAGE CONTAINER

The present invention relates to improvements for lipstick and more particularly to packaging which satisfies the retailer's need for providing an attractive point-of-sales presentation for the product and also caters to the convenience of the purchaser insofar as assisting her in the use of the product.

Lipstick cannot be readily applied without the use of a mirror since the reflected image assists in proper application of the lipstick mass. The lipstick container of U.S. Pat. No. 2,121,221 exemplifies the embodiment of a mirror for such purpose of assisting the user, but otherwise has no utility. It is questionable therefore whether the cost of including the mirror in the container of the lipstick, as is done in the referred to patent, is warranted or whether the consumer should simply be supplied with the lipstick and equip herself with an appropriate mirror. In the latter case, of course, there is the possible inconvenience of the mirror being inadvertently misplaced when needed to assist in applying the lipstick thereby offsetting the advantage of the cost saving.

Broadly, it is an object of the present invention to provide an improved mirror-embodied lipstick container overcoming the foregoing and other shortcomings of the prior art. Specifically, it is an object to provide a convenience mirror for the purchaser, which mirror also significantly contributes to providing an enhanced appearance to the product in its point-of-sales display.

A combination lipstick display and storage container demonstrating objects and advantages of the present invention includes a panel that is vertically oriented during display service of the container. A cooperating arrangement of walls extend laterally from the base of the panel and bound a compartment sized to provide a friction fit with a lipstick projected therein. A rectangular mirror is mounted lengthwise on the panel and thus in a strategic position behind the lipstick so as to contribute to providing an enhanced appearance thereto during display service of the container. The referred to mirror, following removal subsequently of the lipstick, is intended to be oriented horizontally and in this position contributes to facilitating the application of the lipstick on the lips of the user by the image reflected thereon.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

It is already known, as exemplified by prior U.S. Pat. No. 2,121,221 that embodying a mirror in a container for a lipstick provides the user with the convenience of using said mirror in the application of the lipstick mass. Moreover, since the lipstick typically is of an elongated shape, i.e. a shape in which the dimension lengthwise of the lipstick mass is several times that of its diameter or width, the mirror of a corresponding elongated shape is useful during application of the lipstick mass. What is necessary is merely to turn the container embodying the mirror so that the mirror is horizontally oriented and as a result the length thereof is sufficient for the user to see enough of a reflected image of the lips so that application of the lipstick mass is significantly enhanced.

Thus far what has been described is acknowledged prior art. To such prior art it is the contribution of the present invention to use a mirror so embodied in the container of a lipstick as to also provide a significantly enhanced point-of-sales display for this type product, all as will now be described in detail.

Figure 4:
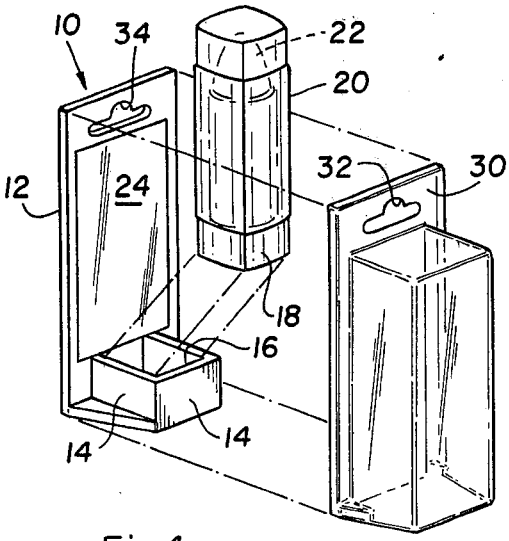
FIG. 4 is an exploded perspective view illustrating additional details of the container and lipstick and also the preferred manner of packaging same preparatory to commercial sale thereof.
Figure 1:
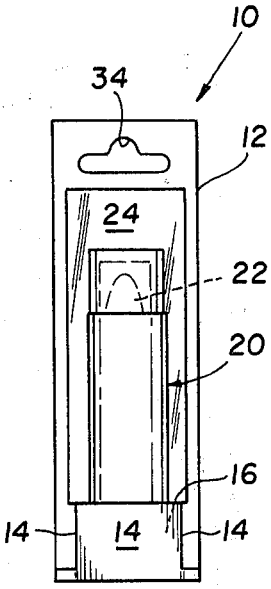
FIGS. 1 and 2 are respectively front and side elevational views of a lipstick in the improved container hereof during which said container effectively functions as an effective point-of-sales display package.
Figure 2:
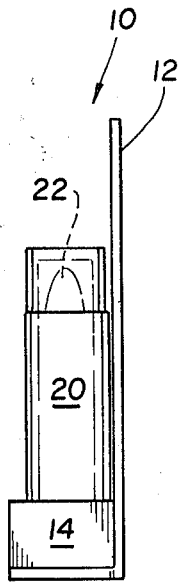
Figure 5:
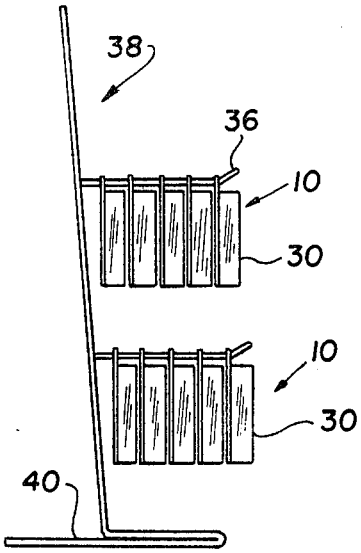
FIGS. 5 and 6 are respectively a side elevational and perspective view of a typical point-of-sales display rack for the assembled package of FIG. 4.
Figure 6:
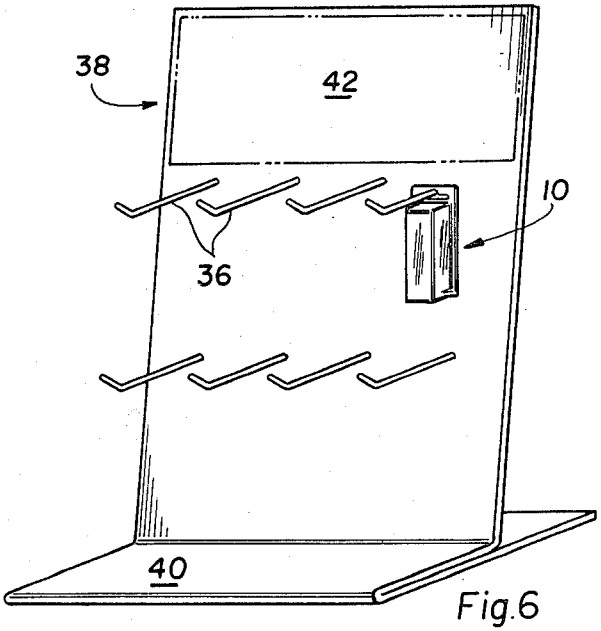

More particularly, and referring to FIGS. 1 and 2, the container for the lipstick generally designated 10, includes a rectangular panel 12 that assumes a vertical orientation during display service of the container. Extending laterally from the base of panel 12 are a cooperating arrangement of side and front walls, individually and collectively designated 14, which bound a compartment 16 of a selected size and shape (see in particular FIG. 4) to provide a friction fit for an appropriately sized and shaped base 18 of the actual lipstick container 20 for the lipstick mass 22.

Completing the construction of the overall lipstick container 10 is a rectangular mirror 24 that is adhesively or otherwise appropriately attached lengthwise of the panel 12. Although difficult to demonstrate in FIGS. 1 and 2, it will be understood that the strategic location of the mirror 24 behind the lipstick container 20 provides a noteworthy and enhanced appearance to the lipstick for any point-of-sales display. That is, the reflection of the lipstick 20 provided by the mirror 24 which is in facing relation to the customer provides a noteworthy appearance to the product which significantly contributes to the launching of sales thereof.

Figure 3:
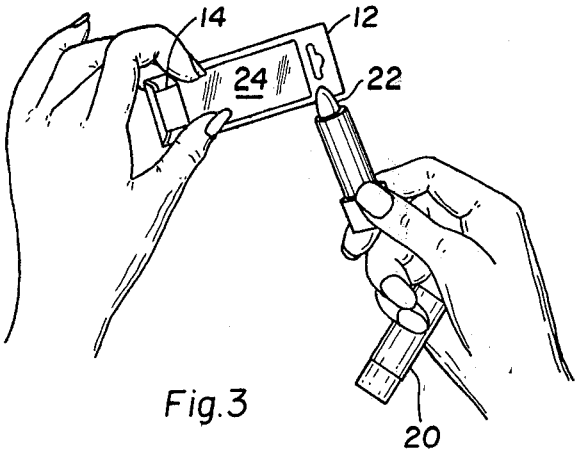
FIG. 3 is a perspective view which illustrates how the container after purchase of the lipstick is then effectively used for the storage thereof and, more particularly, to assist in the application of the lipstick on the lips of the user.

In addition, the container 10 for the lipstick 20 as just described is also effective as a storage convenience package for the lipstick. That is, it is contemplated that even after purchase the lipstick tube 20 in its friction fit within compartment 16 will be carried about by the consumer in her purse or otherwise in this condition. And, as is best illustrated in FIG. 3, preparatory to use, it is contemplated that the lipstick will be removed from the compartment 16 and the outer tube 20 removed therefrom exposing the lipstick mass 22. The lipstick mass 22 in one hand can then be applied to the lips of the user and this will be facilitated by the user turning the mirror 24 so that it is generally horizontally oriented. The gripping and manipulation of the mirror as just indicated is assisted by using the walls 14 as a finger grip, all as is illustrated in FIG. 3.

In a preferred commercial package including the combination display and storage container 10 and lipstick 20, it is preferred to further include an appropriately shaped clear plastic cover 30 which is mounted over the components in their assembled condition of FIGS. 1, 2. Plastic cover 30 has an appropriate opening 32 adjacent its upper edge which aligns with opening 34 adjacent the upper edge of the vertical display panel 12 of the container 10. It is of course through the aligned openings 34 and 32 that there is projected, in practice, an appropriate hook or container-supporting member 36 of a point-of-sales display rack 38 of the type which is held erect or vertical by a base 40 and typically has a display area 42 for a commercial message.

To summarize, there has been described herein a container 10 for a lipstick 20 which serves, in a noteworthy fashion, both as an effective point-of-sales display package wherein a reflected image of the product is presented by a mirror 24 in facing relation to the customer, and also as a storage container for the lipstick. As a storage container, mirror 24 when oriented horizontally is effective in providing an appropriate reflected image of the user's lips to assist in the application thereof of the lipstick mass.

Whether the combination container of lipstick 10,20 as described herein is used with or without the plastic cover 30 depends on its vulnerability to pilferage and other circumstances. To this extent, therefore, the plastic cover 30 is not an essential and necessary part of the invention. On the other hand, the option of using the cover 30 is rendered feasible by virtue of the cover being able to be placed in covering relation over the combination container 10 and lipstick 20 and in the aligned relation that exists between the opening 32 of cover 30 and of opening 34 of the vertical panel 12 of container 10. Thus, in the cooperating relationship just noted there is a contribution to existing lipstick packaging and this contribution will be understood to be part of the within invention.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A combination lipstick display and storage container comprising a panel that is vertically oriented during display service of said container, a cooperating arrangement of walls extending laterally from the base of said panel bounding a sized compartment providing a friction fit with a lipstick projected therein, and a rectangular mirror mounted lengthwise on said panel behind said lipstick to contribute to providing an enhanced appearance thereto during display service of said container, and whereby said mirror following removal subsequently of said lipstick and upon being oriented horizontally also contributes to facilitating the application of said lipstick on the lips of the user by the image reflected thereon.

2. A combination lipstick display and storage container as claimed in claim 1 including an opening adjacent the upper edge of said panel for receiving therethrough a container-supporting member of a point-of-sales display.

3. A combination lipstick display and storage container as claimed in claim 2 including a removable transparent cover in covering relation over said lipstick and container to minimize the pilferaging removal of said lipstick from said container, and wherein said transparent cover also has an opening in alignment with said opening of said panel for said projecting container-supporting member.

* * * * *